United States Patent [19]

Jarosz et al.

[11] 4,103,120

[45] Jul. 25, 1978

[54] AUXILIARY MECHANISM FOR IMPARTING ROTATIONAL ENERGY TO ELECTRICAL COMPONENTS

[75] Inventors: John M. Jarosz, Chicago; Roy T. Swanson, North Riverside, both of Ill.

[73] Assignee: S & C Electric Company, Chicago, Ill.

[21] Appl. No.: 670,742

[22] Filed: Mar. 26, 1976

[51] Int. Cl.[2] ..... H01H 31/00

[52] U.S. Cl. ..... 200/48 R; 200/48 A; 200/48 P; 74/822; 74/88; 74/99 R; 74/106

[58] Field of Search ..... 200/48 R, 48 P, 48 A; 74/822, 88, 99 R, 106

[56] References Cited

U.S. PATENT DOCUMENTS

| | | | |
|---|---|---|---|
| 3,184,567 | 5/1965 | Gussow | 200/48 R |
| 3,508,178 | 4/1970 | Chabala et al. | 335/1 |
| 3,590,178 | 6/1971 | Kuhn | 200/48 |
| 3,637,959 | 1/1972 | Bridges | 200/48 |
| 3,668,341 | 6/1972 | Smedley et al. | 200/48 R |
| 3,830,994 | 8/1974 | Netzel | 200/48 |
| 3,838,604 | 10/1974 | Meister | 74/99 |

*Primary Examiner*—Brooks H. Hunt
*Attorney, Agent, or Firm*—Kirkland & Ellis

[57] ABSTRACT

Disclosed is an auxiliary mechanism for rapidly imparting rotational energy to electrical switch components. An insulator connects an electrical switch component to an output shaft mounted for rotation in the mechanism housing. A lever arm assembly is mounted on the shaft and a link member is pivotably connected between the lever arm assembly and a first arm extending from a bellcrank member. The bellcrank member is mounted for rotation in the housing and has a second arm that is operably connected to one or more solenoids. Initially the link member and first arm are in an overcenter toggle position so that the insulator cannot be accidentally rotated. Energization of the solenoid causes rapid rotation of the insulator because the mechanical advantage of the system in such that maximum force is applied initially. Once the solenoid is de-energized, a spring connected between an extended end of the lever arm assembly and the end of the first arm returns the mechanism to its initial position with the first arm and link member in the overcenter toggle position thereby locking the output shaft and the insulator in the initial unoperated position.

20 Claims, 8 Drawing Figures

46
52
5
40
74
70
94
76
84
54
90
100
62
98
6
64
104
106
66
78
108
58
64
104
62
98
96
100
92
84
88
76
72
74
126
128
130
132
5

AUXILIARY MECHANISM FOR IMPARTING ROTATIONAL ENERGY TO ELECTRICAL COMPONENTS

BACKGROUND OF THE INVENTION

1. Field of the Invention

The present invention relates to operating mechanisms for electrical switch components and more particularly to auxiliary operating mechanisms for imparting rotational energy to circuit interrupting switch devices and the like.

2. Description of the Prior Art

The present invention is an improvement over the mechanism disclosed in U.S. Pat. No. 3,508,178 — Chabala et al. assigned to the same assignee as the present invention. As the foregoing patent illustrates, it is well known in the art to provide current interrupter arrangements in high voltage circuits. In that patent, there is disclosed a spring operated latch release mechanism for opening the contacts of a current interrupter connected in series with a disconnect switch blade which may be subsequently opened. Also disclosed in that patent is a solenoid operated auxiliary trip operator mechanism arranged to release the latch mechanism separately from and in advance of its release by the switch operating mechanism.

In such an arrangement, it is desirable to provide a predetermined amount of rotational energy very quickly to an output shaft so that high initial rotary force permits rapid acceleration of an insulator mass interconnecting the auxiliary mechanism with the current interrupter operating mechanism. Further, to prevent accidental operation of the interrupter arrangement, it is desirable to provide some means to prevent rotation of the output shaft by external forces. In addition, after operation of the auxiliary mechanism, it is desirable to provide an automatic return so that the auxiliary mechanism will return to its initial unoperated position. Also, since such mechanisms are typically installed in the field, it is desirable to provide a means for compensating for axial and longitudinal misalignment of the output shaft of the auxiliary mechanism and the input shaft of the interrupter switch mechanism. It is also desirable to compensate for variations in insulator length, distance between the auxiliary mechanism and the interrupter unit operating mechanism and crooked insulators.

The present invention comprises unique means of providing all of the foregoing desirable features.

BRIEF DESCRIPTION OF THE INVENTION

A mechanism for imparting rotational energy in accordance with the present invention comprises an output shaft mounted for rotation, and a lever means mounted on the shaft. An overcenter toggle linkage means is connected to the lever means for preventing rotation of the output shaft when the overcenter toggle linkage means is in an overcenter toggle position. A force applying means is provided for causing the overcenter toggle linkage means to move out of the overcenter toggle position and rotate the lever means and output shaft rapidly. After the force applying means ceases applying a force, a bias means is provided for returning the overcenter toggle linkage means to the overcenter toggle position thereby returning the output shaft to its initial position.

Preferably, the output shaft is connected by an insulator to the input shaft of a current interrupter operating mechanism. The overcenter toggle linkage means prevents accidental rotation of the insulator by external forces thereby essentially locking the insulator in position until such time as the force applying means is activated.

Because of the particular geometry of the overcenter toggle linkage means and the lever means, the mechanical advantage is such that maximum force is applied initially to the output shaft thereby providing high initial rotary force to the output shaft thereby rapidly accelerating the insulator mass.

The bias means, which preferably comprises a spring, is preferably connected between the center of the toggle linkage means and an extended end of the lever means so that there is a positive force returning the system to its initial position after the force applying means ceases to apply force. In this manner, the mechanism is returned to its initial locked condition subsequent to each operation. This arrangement provides a relatively high return force compared to the spring force.

In addition, a self-aligning means may be provided between the end of the output shaft and the insulator for compensating for any misalignment between the output shaft and the input shaft of the current interrupter operating mechanism so that the shaft and insulator will rotate freely without binding.

Thus, it is a principal object of the present invention to provide an operating mechanism for imparting rotational energy that provides a predetermined amount of rotary motion to an output shaft very quickly.

Yet another object of the present invention is to provide an operating mechanism for imparting rotational energy wherein high initial rotary force is applied to the output shaft for causing rapid acceleration of the shaft.

Yet another object of the present invention is to provide an operating mechanism for imparting rotational energy which includes a means for preventing rotation of the output shaft when external forces are applied whenever the shaft is in its initial unoperated position.

A further object of the present invention is to provide an operating mechanism for imparting rotational energy having a means of compensating for misalignment of the output shaft with the input shaft of a driven mechanism.

A further object of the present invention is to provide automatic means for returning the mechanism to its initial unoperated position.

These and other objects, advantages and features will hereinafter appear, and for the purposes of illustration, and not of limitation, an exemplary embodiment is illustrated in the attached drawings.

DESCRIPTION OF THE PREFERRED EMBODIMENT

Figure 1:
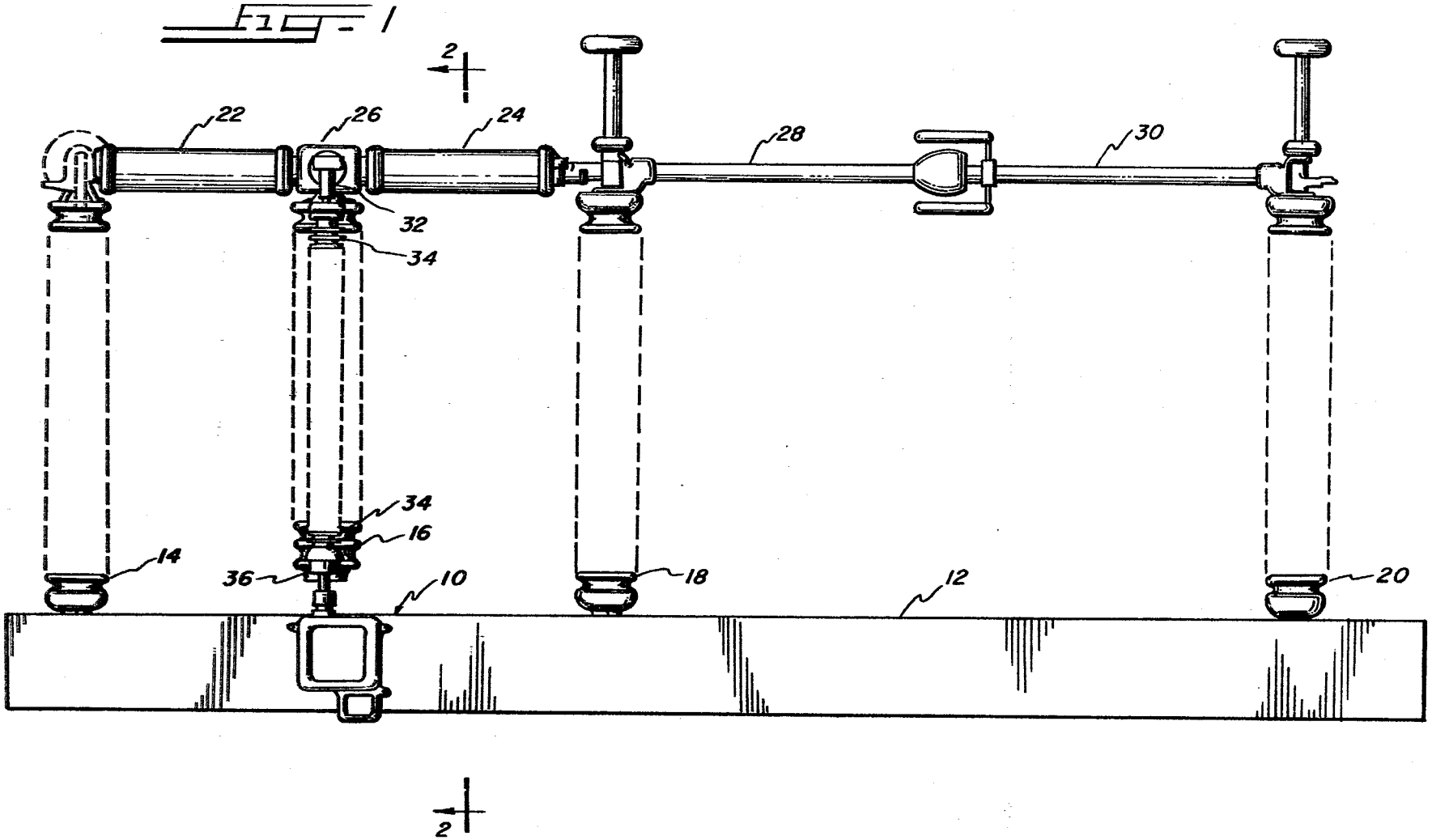
FIG. 1 is a side elevational view of a preferred embodiment of the present invention mounted on a current interrupter switch and disconnect switch blade arrangement.

With reference to FIG. 1, operating mechanism 10 is mounted on a base member 12 that may comprise a conventional steel box beam member. Also mounted on base member 12 are insulators 14, 16, 18 and 20. Mounted at the top of and between insulators 14 and 16 is a current interrupter 22, and mounted on top of and between insulators 16 and 18 is a current interrupter 24. Mounted on top of insulator 16 between current interrupter 22 and 24 is current interrupter operating mechanism 26.

Mounted on top of insulator 18 for pivotable movement is first disconnect switch blade 28. Mounted on top of insulator 20 for pivotable movement is second disconnect switch blade 30. Switch blades 28 and 30 are normally closed in the position shown but may be pivoted to an open position. One side of a high voltage circuit is connected to current interrupter 22 and the other side of a high voltage circuit is connected to switch blade 30 so that a circuit may be formed through current interrupters 22 and 24 and switch blades 28 and 30. Current interrupter operating mechanism 26 is adapted to operate current interrupters 22 and 24 when insulator 16 is pivoted to interrupt current flow throughout the circuit so that disconnect switch blades 28 and 30 can be pivoted to open the circuit.

Figure 2:
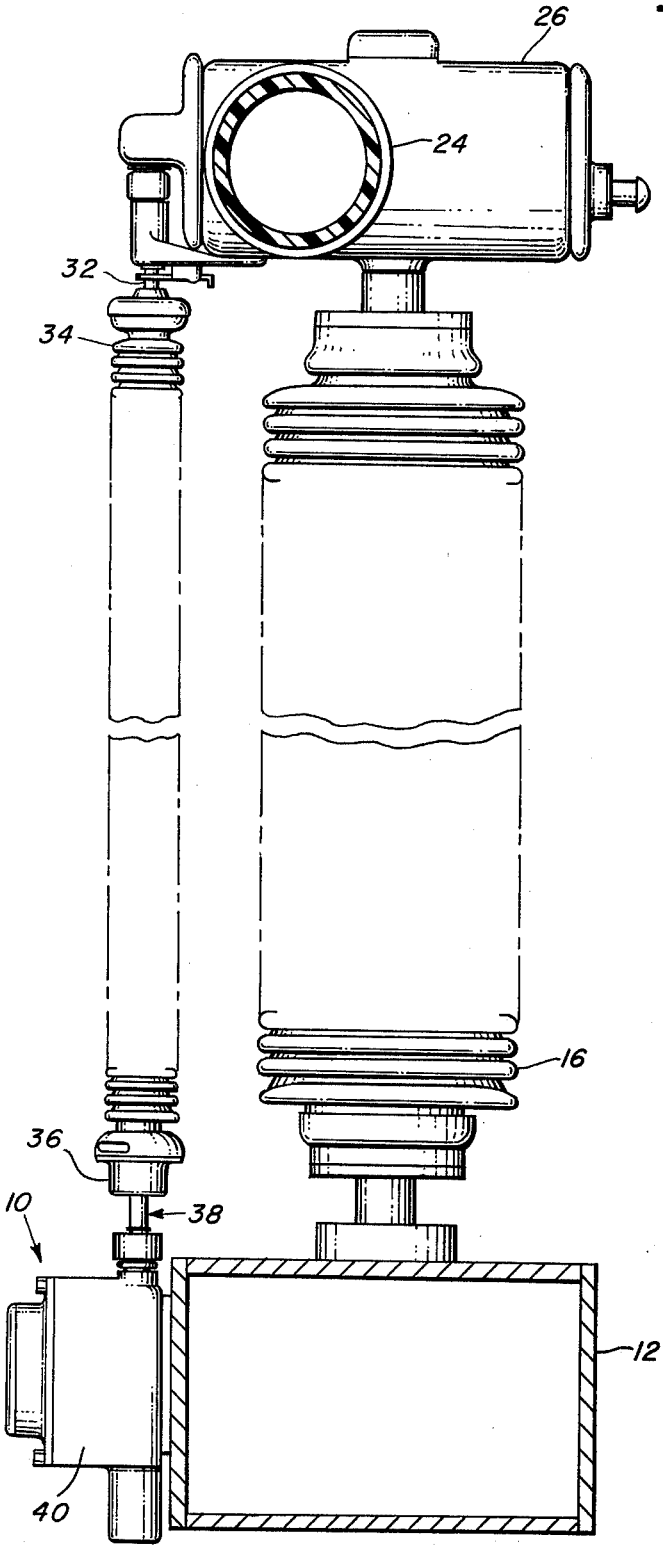
FIG. 2 is a side elevational view taken substantially along line 2—2 in FIG. 1.
Figure 3:
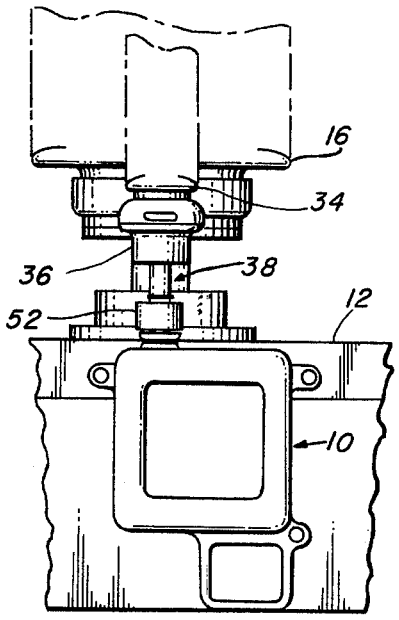
FIG. 3 is a front elevational partially fragmentary view of the preferred embodiment of the present invention.

With reference to FIGS. 1 and 2, current interrupter operating mechanism 26 has an input shaft 32 connected to an insulator 34. Current interrupter operating mechanism 26 is arranged so that rotation of input shaft 32 causes the operating mechanism 26 to operate current interrupter 22 and 24 to interrupt current flow. This method of operation is in addition to the operation of current interrupter operating mechanism 26 solely by rotation of insulator 16.

Insulator 34 is connected at its lower end by an alignment means 36 to an output shaft assembly 38 extending through the housing 40 of operating mechanism 10.

Figure 4:
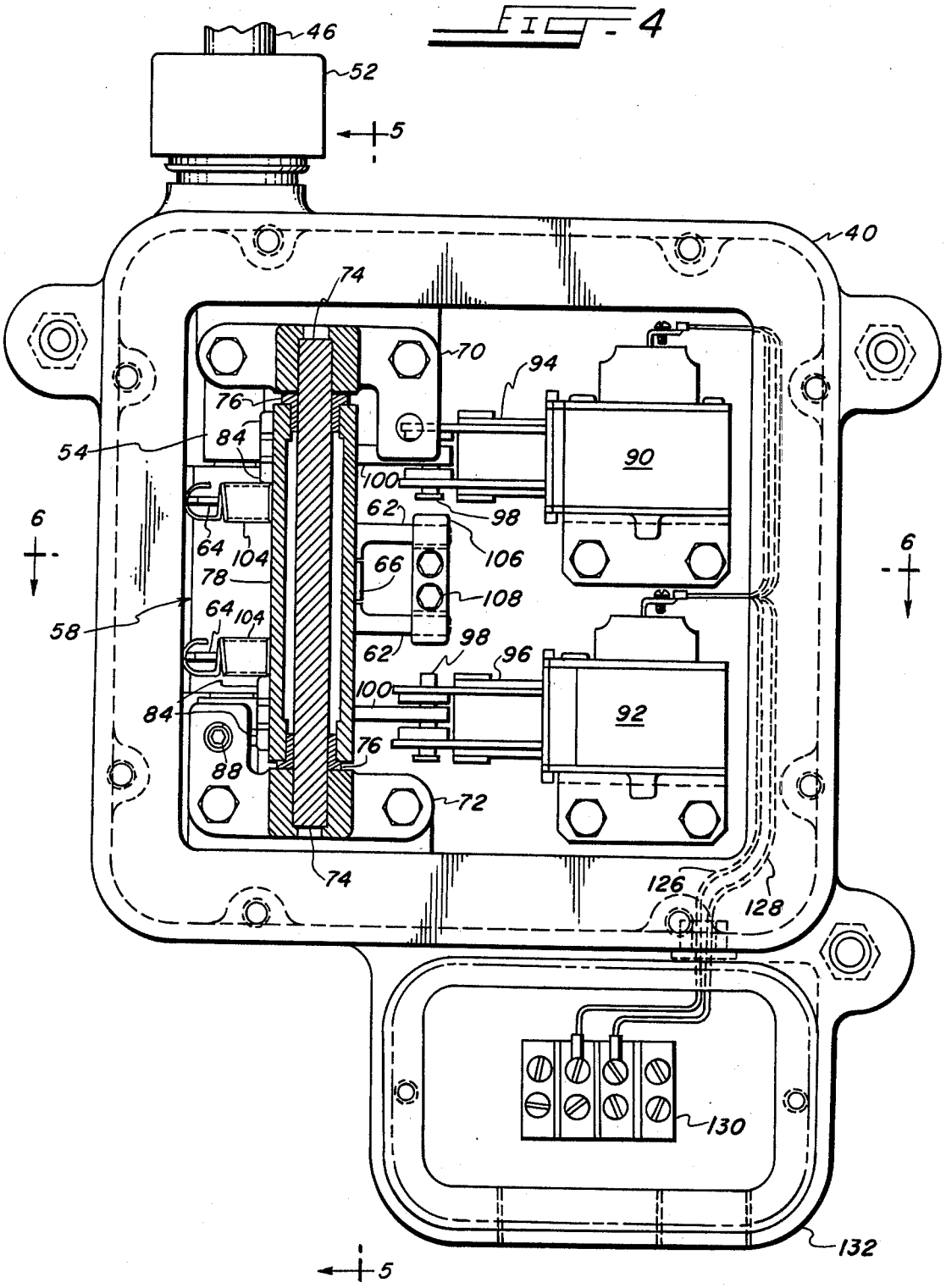
FIG. 4 is a front partially cross-sectional view of a preferred embodiment of the present invention with the front cover removed.
Figure 5:
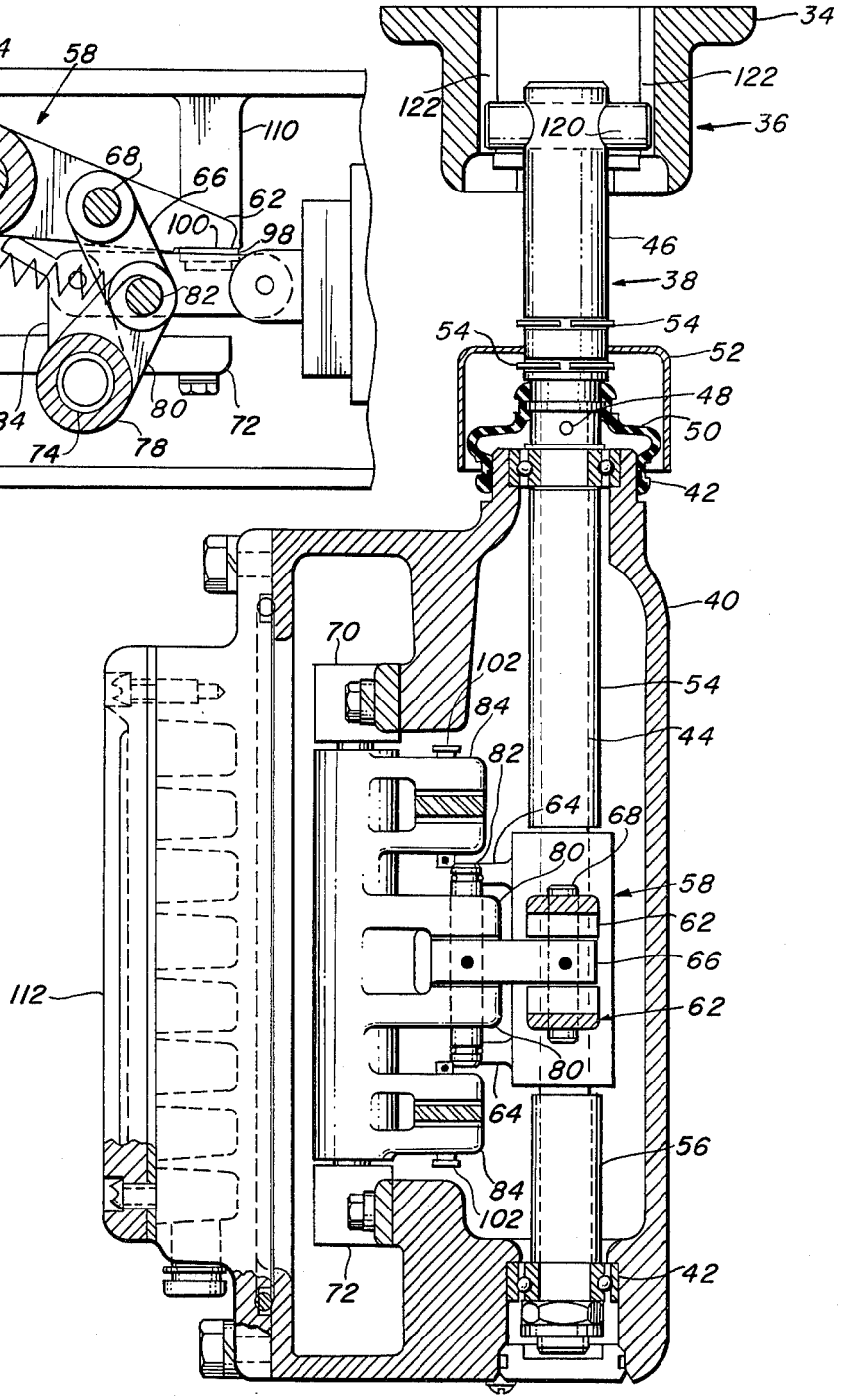
FIG. 5 is a side partially cross-sectional view of the preferred embodiment of the present invention taken substantially along the line 5—5 in FIG. 4.
Figure 6:
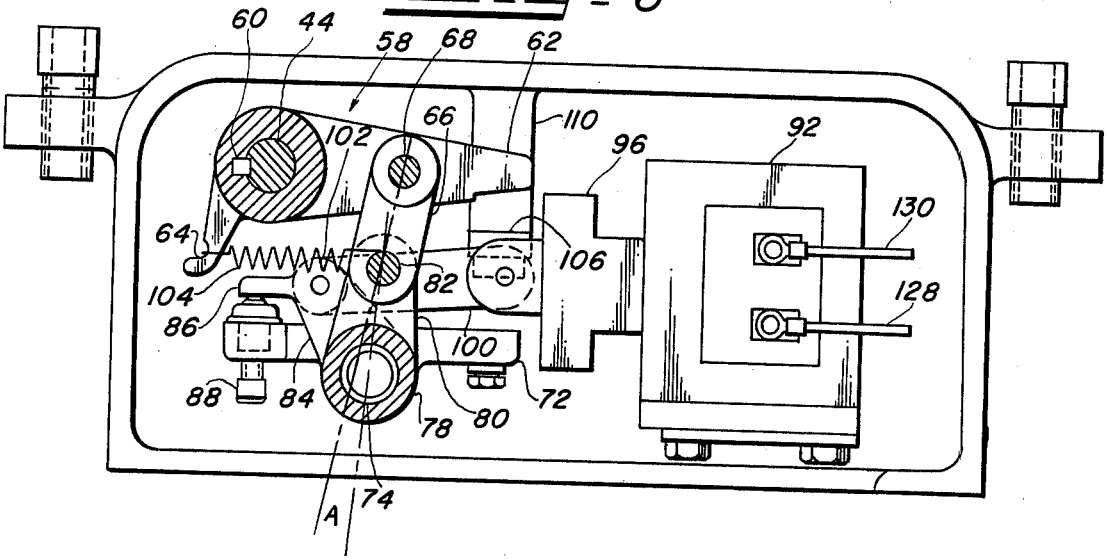
FIG. 6 is a top cross-sectional view of the preferred embodiment of the present invention taken substantially along line 6—6 in FIG. 4.
Figure 7:
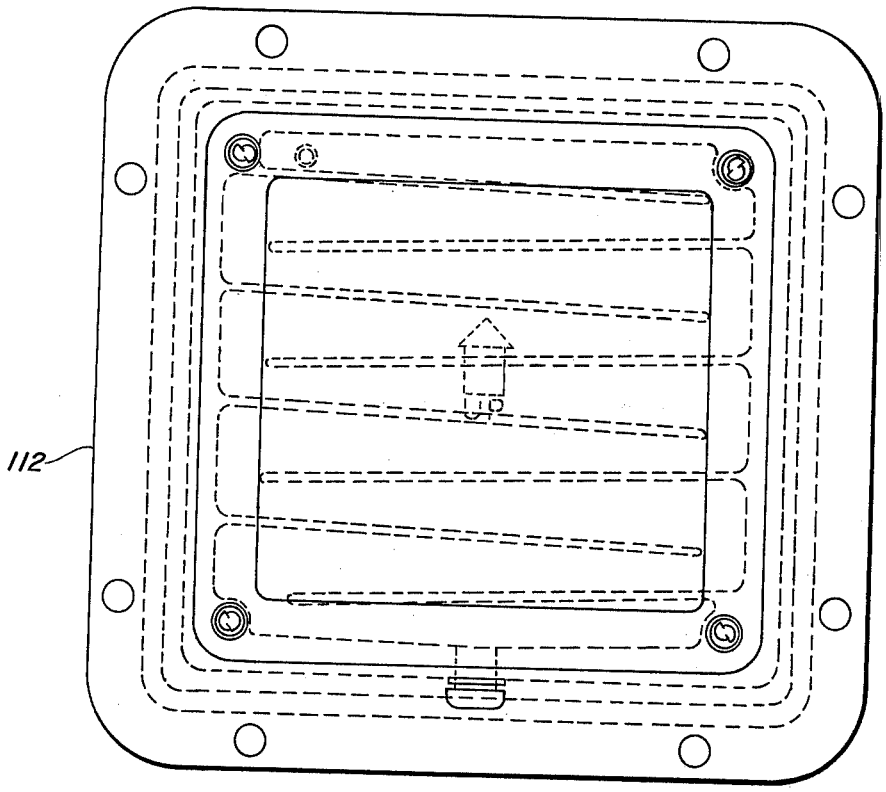
FIG. 7 is a front view of the front cover of the preferred embodiment of the present invention.

With reference to FIGS. 4, 5, and 6, output shaft assembly 38 extends through the top of housing 40 of operating mechanism 10 and is supported for rotation at the top and bottom of housing 40 by bearings 42.

Shaft assembly 38 comprises a cylindrical shaft 44. Mounted to the top of shaft 44 by a pin 48 is shaft head assembly 46. Tightly mounted around shaft head assembly 46 and sealing against housing 40 is a rubber seal 50 that prevents moisture from entering housing 40. Positioned over rubber seal 50 is a metal shield 52 that prevents accidental puncture of rubber seal 50. Shield 52 is held in position by retaining rings 54. Within housing 40, spacers 54 and 56 are positioned around shaft 44. Mounted between spacers 54 and 56 on shaft 44 is lever arm assembly 58.

With reference to FIG. 6, lever arm assembly 58 is keyed to shaft 44 by a key 60 riding in a machined keyway. Lever arm assembly 58 comprises first ends 62 extending outwardly in a radial direction perpendicular to shaft 44. As shown in FIGS. 4 and 5, two first ends 62 extend from lever arm assembly 58. Also extending outwardly in a radial direction perpendicular to shaft 44 are second ends 64 of lever arm assembly 58. As shown in FIGS. 4 and 5, two such second ends 64 extend from lever arm assembly 58. Pivotably mounted at one end to first ends 62 of lever arm assembly 58 by a shaft 68 is a link 66.

With reference to FIG. 4, bolted to the interior of housing 40 are upper bracket 70 and lower bracket 72. Mounted between upper and lower brackets 70 and 72 is a shaft 74. Bearings 76 are positioned around shaft 74 and support a bellcrank member 78 for rotation around shaft 74. Formed on and extending radially from the body of bellcrank member 78 are first arms 80 (See FIG. 5). Extending through first arms 80 is a pin 82 which pivotably connects the other end of link 66 between first arms 80. Also formed on and extending radially from bellcrank member 78 are second arms 84. Second arms 84 extend outwardly at an angle with respect to first arms 80 as shown in FIG. 6. Formed on the end of one of the second arms 84 is a stop flange 86 that normally engages a stop screw 88 mounted on the end of lower bracket 72. Stop screw 88 is adjustable so that the position at which stop flange 86 engages stop screw 88 can be varied.

Two solenoids 90 and 92 are bolted to the rear of housing 40, and the armatures 94 and 96 of solenoids 90 and 92 are respectively connected by pins 98 to one end of links 100. The other end of links 100 are respectively pivotably connected to second arms 84 by pins 102 (See FIG. 6). Two springs 104 are connected between the second ends 64 of lever arm assembly 58 and the ends of shaft 82.

With reference to FIGS. 4 and 6, a stop member 106 is bolted by bolts 108 to the end of an extension 110 extending from the back wall of housing 40. Stop member 106 is positioned to engage the first ends 62 of lever arm assembly 58 when pivoted to the position shown in FIG. 8.

Mounted to the front of housing 40 is an aerator cover 112 which is substantially as described in U.S. Pat. No. 3,696,729. Aerator cover 112 does not specifically form a part of the present invention but is illustrated to show how it may be used as a cover for housing 40.

As previously described, shaft head assembly 46 is mounted to the end of shaft 44. Shaft head assembly 46 comprises engaging extensions in the form of cross pin 120 that extends radially in opposite directions from the end of shaft assembly 46. Cross pin 120 is dimensioned to slide into and engage grooves 122 vertically formed 180° apart on opposite sides of an interior portion of an adapter on the bottom of insulator 34. The junction between cross pin 120 and grooves 122 comprises an alignment means 36 which permits output shaft assembly 38 to rotate freely even if insulator 34 is misaligned or tilted at an angle with respect to the axis of rotation of the output shaft assembly 38. This feature is particularly advantageous since the present invention is typically installed in the field where it is difficult to perfectly align the output shaft with the input shaft of the interrupter switch operating mechanism 26 or other such driven mechanisms. This feature also permits longitudinal motion which occurs due to wind or operating forces.

Solenoids 90 and 92 are electrically connected by wires 126 and 128 to a terminal board 130 in a lower housing 132. Appropriate control circuitry may be used to apply electrical power through terminal board 130 to energize solenoids 90 and 92 at the appropriate times.

Initially the mechanism 10 is in the position illustrated in FIGS. 4, 5, and 6. In this position, link 66 and first arms 80 are in an overcenter toggle position as illustrated in FIG. 6 and form an overcenter toggle linkage means so that lines drawn between the centers of shafts 68, 82 and 74 form a small angle A as shown in FIG. 6. In this overcenter toggle position, stop flange 86 is firmly pressed against stop screw 88 so that bellcrank member 78 cannot rotate any further in a counterclockwise direction as viewed in FIG. 6. As previously described, the small angle A can be varied by adjusting stop screw 88 so that the desired overcenter toggle position can be achieved. Spring 104 exerts a bias force against shaft 82 and the second ends 64 of lever arm assembly 58 thereby tending to urge link 66 and first arms 80 to remain in the overcenter toggle position. In this position, shaft 44 cannot be rotated in either direction by the application of external forces to the end of shaft 44. It is desirable to lock shaft 44 in such a manner to prevent external forces from accidentally rotating insulator 34 causing accidental operation of the current interrupters 22 and 24. If shaft 44 is rotated in a clockwise direction as viewed in FIG. 6, the overcenter toggle condition causes stop flange 86 to press against stop screw 88 preventing rotation of shaft 44 in that direction. If shaft 44 is rotated in a counterclockwise direction as viewed in FIG. 6, link 66 pulls against first arms 80 preventing rotation of shaft 44 in that direction. Accordingly, shaft 44 is essentially locked in position and cannot be rotated as a result of the application of external forces while in this overcenter toggle position.

Figure 8:
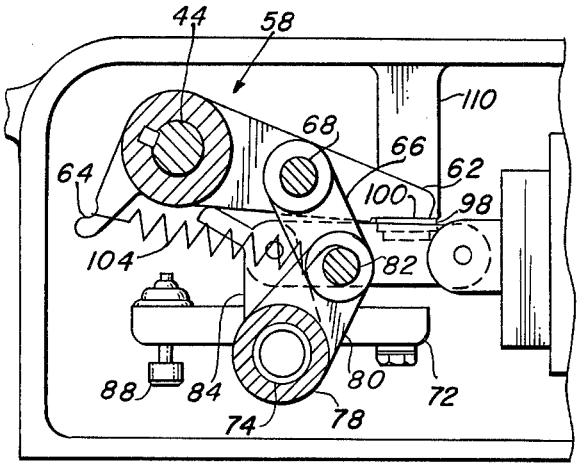
FIG. 8 is a cross-sectional partially fragmentary view of the preferred embodiment of the present invention illustrated in FIG. 6 showing the members in an operated position.

However, if solenoids 90 and 92 are energized so that armatures 94 and 96 are moved to the right as viewed in FIGS. 4 and 6, links 100 pull against second arms 84 causing bellcrank member 78 to pivot in a clockwise direction as viewed in FIG. 6 thereby moving first arms 80 and link 66 out of the overcenter toggle position. This clockwise rotation of bellcrank member 78 causes first arms 80 to pull link 66 which in turn pulls first ends 62 of lever arm assembly 58 thereby pivoting shaft 44 in a clockwise direction as viewed in FIGS. 6 and 8. FIG. 8 illustrates the position of the members when the armatures are in their fully retracted position illustrating how lever arm assembly 58 and shaft 44 are rotated until first end 62 engages stop member 106 on the end of extension 110 thereby stopping rotation of shaft 44. While the angle of rotation of shaft assembly 38 is relatively small, it is sufficient to cause the current interrupter operating mechanism 26 to operate current interrupters 22 and 24.

When solenoids 90 and 92 are de-energized, springs 104 pull bellcrank member 78 and lever arm assembly 58 in a counterclockwise direction as viewed in FIGS. 6 and 8 until the members reach the position illustrated in FIG. 6 with link 66 and first arms 80 in the overcenter toggle position. Thus, after operation of the mechanism 10, the mechanism automatically returns to its initial position thereby locking shaft 44.

It should be noted that second arms 84 extend outwardly at an angle with respect to first arm 80 of bellcrank member 78. The particular angle at which second arms 84 is positioned is selected so that the force applied by link 100 is essentially tangential throughout the arc of travel of the end of second arms 84. Such an arrangement permits the force applied by the solenoid to be applied essentially perpendicular to the arc of travel of second arm 84 throughout the arc and also facilitates in reducing the overall size of the operating mechanism 10.

An additional advantage of the present invention is that high initial torque forces can be applied to shaft 44 using the geometry of the present invention. In particular, when the solenoids initially operate, the solenoids are initially only operating against the force applied by springs 104 thus maximizing the amount of energy transmitted during the initial period of solenoid operation when the force applied by the solenoids is at its lowest level. Further, the mechanical advantage created by having link 66 positioned in an essentially perpendicular position with respect to the first ends 62 of lever arm assembly 58 provides a mechanical advantage that increases the initial rotational forces applied to shaft 44 thereby permitting rapid acceleration of the mass of insulator 36. This mechanical advantage is diminished as link 66 pivots, but the force applied by solenoids 90 and 92 increases as the armatures 94 and 96 move closer to a fully retracted position.

An additional advantage of the present invention is that by attaching springs 104 between second ends 64 of lever arm assembly 58 and shaft 82 connecting link 66 and first arms 80, double leverage is provided so that a more positive force is applied to return shaft 44 to its initial position. This same geometry permits high accelerating forces to be applied at the initiation of the operating stroke. Also, the present invention is not limited to two return springs 104 as shown, and various sizes and numbers of return springs could be used. Further, in the return mode, the geometry of this system is such that when springs 104 are fully extended (thereby providing maximum force), the mechanical advantage is at a minimum, but as the springs 104 contract (and their force decreases) the mechanical advantage increases, thereby providing a relatively uniform return torque.

A further advantage of the present invention is that since the solenoids 90 and 92 are connected to a common bellcrank member 78, they are constrained to operate in tandem so that solenoids 90 and 92 could be electrically connected either in series or parallel. This feature allows the selection of various voltage ratings with fewer types of solenoid coils.

It should be expressly understood that various changes, modifications, and alterations in the structure of the present invention may be made without departing from the spirit and scope of the present invention as defined in the appended claims. For example, it is not necessary that solenoids be used, and any force applying means, such as a hydraulic piston or spring and latch arrangement, may be effectively used.

We claim:

1. A mechanism for imparting rotational energy comprising:

an output shaft mounted for rotation between a first and second position;

lever means mounted on the shaft for applying rotational forces to said shaft;

overcenter toggle linkage means connected to the lever means for preventing rotation of said output shaft from its first position when said overcenter toggle linkage is in an overcenter toggle position and for causing said lever means to rotate said shaft to its second position when moved out of the overcenter toggle position;

force applying means for causing the overcenter toggle linkage means to move out of the overcenter toggle position and rotate said lever means and output shaft rapidly to its second position in such a manner that increased mechanical advantage is applied by said overcenter toggle linkage means during initial operation so that high initial torque forces are applied to said output shaft;

bias means for returning the overcenter toggle linkage means to the overcenter toggle position after said force applying means ceases applying a force thereby returning the output shaft to its first position.

2. A mechanism, as claimed in claim 1, wherein said overcenter toggle linkage means comprises:

a first link pivotably mounted at one end to said lever means;

a bellcrank member mounted for rotation including a first arm extending therefrom, said first arm pivotably connected at its extended end to the other end of said first link.

3. A mechanism, as claimed in claim 2, wherein said bellcrank member further comprises a plurality of second arms and wherein said force applying means comprises a plurality of solenoids, each of said solenoids being operably connected to a respective second arm so that said solenoids will be constrained to operate conjointly.

4. A mechanism, as claimed in claim 2, wherein said force applying means comprises at least one solenoid.

5. A mechanism, as claimed in claim 4, wherein said solenoid is operably connected to a second arm extending from said bellcrank member so that energization of said solenoid causes said bellcrank member to rotate.

6. A mechanism, as claimed in claim 2, wherein said lever means comprises a first end extending outwardly therefrom and a second end extending outwardly therefrom, and said first link is pivotably connected to said first end.

7. A mechanism, as claimed in claim 6, wherein said bias means is a spring connected between the pivot connection of said first link and said first arm and said second end of said lever means.

8. A mechanism, as claimed in claim 1 further comprising adjustable stop means for adjusting the overcenter toggle position of said overcenter toggle linkage means.

9. A mechanism for imparting rotational energy to electrical switch components comprising:

a housing;

a shaft mounted for rotation in the housing and having an end extending through an opening in the housing;

insulator means for connecting the electrical switch components to the end of said shaft extending through the opening in the housing;

a lever member mounted on the shaft including a first end extending therefrom radially with respect to said shaft;

a first link member pivotably mounted at one end to said first end of said lever member;

a bellcrank member mounted for rotation including first and second arms extending outwardly therefrom, said first arm being pivotably connected at its extended end to the other end of said first link member;

force applying means for applying a force;

means for connecting said force applying means to the extended end of said second arm;

bias means for urging said bellcrank member to rotate so that said first link and said first arm are normally positioned in an overcenter toggle position;

said force applying means applying the force to said means for connecting so that said bellcrank member rotates causing said first link member and said first arm to move out of the overcenter toggle position and pivot said lever member and shaft rapidly thereby imparting high initial torque rotational energy through said insulator means to the electrical switch components; and said bias means causing said bellcrank member to rotate in the opposite direction until said first link and said first arm are positioned in an overtoggle position thereby preventing accidental rotation of said shaft when said force applying means ceases to apply a force.

10. A mechanism, as claimed in claim 9, wherein said lever member includes a second end extending radially therefrom at an angle with respect of said first end, and said bias means is connected between said second end and the pivot connection between said first link member and said first arm.

11. A mechanism, as claimed in claim 10, wherein said bias means is a spring.

12. A mechanism, as claimed in claim 9, further comprising adjustable stop means for adjusting the overcenter toggle position of said first link and said first arm.

13. A mechanism, as claimed in claim 9, wherein said force applying means comprises at least one solenoid.

14. A mechanism, as claimed in claim 9, further comprising aligning means connecting said shaft to said insulator means for compensating for axial and longitudinal misalignment between said shaft and said insulator means.

15. A mechanism, as claimed in claim 14, wherein said aligning means comprises:

two slots formed 180° apart on a hollow interior in an end of an adapter mounted on the end of said insulator means;

engaging means extending radially from the end of said shaft in opposite directions and positioned to engage in said slots.

16. A mechanism, as claimed in claim 9, wherein said second arm extends from said bellcrank member in a direction so that the extended end of said second arm has a minimum of curved movement with respect to the direction that said force applying means applies a force when said second arm is caused to move by the force applying means.

17. A mechanism, as claimed in claim 9, wherein the linear force applied by said force applying means is essentially tangential to the arc of travel of the extended end of said second arm.

18. A mechanism, as claimed in claim 9, wherein said first link member is initially positioned substantially perpendicular to said lever arm and said force applying means initially applies a linear force in a direction perpendicular to said first link so that the force initially applied to said lever arm is substantially increased by mechanical leverage.

19. A mechanism, as claimed in claim 9, wherein said means for connecting said force applying means to the extended end of said second arm comprises a second link member pivotably connected at one end to said force applying means and pivotably connected at its other end to said second arm of said bellcrank member.

20. An electromechanical device for producing a rapid rotational output through a predetermined angle comprising:

an output shaft mounted for rotation;

a plurality of solenoids, each solenoid having an armature operatively connected to a common drive member for conjoint movement;

force transmitting means for connecting said drive member to said output shaft in a manner such that actuation of said solenoids will produce simultaneous movement of said armatures and rotation of said output shaft through the predetermined angle, said force transmitting means constructed and oriented so that increased torque force is applied to said output shaft during initial operation of said solenoids.

* * * * *